US005285852A

United States Patent [19]

McLeod

[11] Patent Number: 5,285,852

[45] Date of Patent: Feb. 15, 1994

[54] WELLHEAD ISOLATION TOOL AND METHOD OF USE THEREOF

[76] Inventor: Roderick D. McLeod, 5104 - 125 Street, Edmonton, Alberta, Canada

[21] Appl. No.: 909,716

[22] Filed: Jul. 27, 1992

[30] Foreign Application Priority Data

Nov. 15, 1991 [CA] Canada ..... 2055656-01

[51] Int. Cl.[5] ..... E21B 19/00; E21B 23/04; E21B 33/02

[52] U.S. Cl. ..... 166/379; 166/70; 166/72; 166/77; 166/80

[58] Field of Search ..... 166/379, 77, 70, 75.1, 166/72, 73, 80

[56] References Cited

U.S. PATENT DOCUMENTS

| | | | |
|---|---|---|---|
| 2,056,543 | 10/1936 | Tschappat | 166/80 |
| 3,830,304 | 8/1974 | Cummins | 166/77 |
| 4,111,261 | 9/1978 | Oliver | 166/86 |
| 4,391,324 | 7/1983 | Reed | 166/70 |
| 4,452,304 | 6/1984 | Barrier et al. | 166/70 |
| 4,460,039 | 7/1984 | Knight | 166/80 |
| 4,657,075 | 4/1987 | McLeod | 166/72 |
| 4,691,770 | 9/1987 | McLeod | 166/73 |
| 4,867,243 | 9/1989 | Garner et al. | 166/379 |
| 4,991,650 | 2/1991 | McLeod | 166/72 |
| 4,993,489 | 2/1991 | McLeod | 166/72 |
| 5,020,590 | 6/1991 | McLeod | 166/77 |
| 5,025,857 | 6/1991 | McLeod | 166/77 |

FOREIGN PATENT DOCUMENTS

| | | |
|---|---|---|
| 1094945 | 2/1981 | Canada . |
| 1267078 | 3/1990 | Canada . |
| 1272684 | 8/1990 | Canada . |

*Primary Examiner*—Hoang C. Dang
*Attorney, Agent, or Firm*—Anthony R. Lambert

[57] ABSTRACT

Apparatus for isolating the wellhead equipment from the high pressure fluids pumped down to the producing formation during the well servicing procedures of fracturing and acidizing oil and gas wells utilizes a central mandrel for pumping the fracturing and acidizing fluids through the wellhead equipment and into well tubing or casing. The mandrel is run into the wellhead equipment while enclosed in a pressure containment protection which includes the operating cylinder. The mandrel is locked in position in the wellhead equipment and later extracted from the wellhead equipment while fully enclosed in the pressure containment. The pressure containment mandrel protection and operating cylinder are removed during the well servicing process to give a low profile to the overall wellhead array.

10 Claims, 8 Drawing Sheets

WELLHEAD ISOLATION TOOL AND METHOD OF USE THEREOF

FIELD OF THE INVENTION

This invention relates to an apparatus for use in oil and gas well servicing and specifically to the isolation of wellhead components from the high pressures encountered when performing the procedures of fracturing and acidizing.

BACKGROUND AND SUMMARY OF THE INVENTION

Many of the procedures of oilfield well servicing require that fluids and gases mixed with various chemicals and proppants be pumped down the oil or gas well (henceforth called the well) tubing or casing under high pressures during the operations called acidizing and fracturing. These operations serve to ready the well for production or enhance the present production of the well. The components which make up the wellhead such as the valves, tubing hanger, casing hanger, casing head and also the blow out preventer equipment generally supplied by the well servicing company, are usually sized for the characteristics of the well and are not capable of withstanding the fluid pressures at which these operations of fracturing and acidizing are carried out. There are wellhead components available to withstand high pressures, but it is not economical to equip every well with them. There are many tools which are in use in the field which allow these high pressure fluids and gases to bypass the wellhead components and these tools are generally referred to as wellhead isolation tools or in oilfield terms, tree savers, casing savers and top mounted packers. Some of the most popular in use today would include the inventor's tools; McLeod, a Wellhead Isolation Tool, Canadian Patent No. 1,217,128, U.S. Pat. No. 4,657,075 this tool being used to isolate the wellhead from pressure in the casing; McLeod, a Well Casing Packer, Canadian Patent No. 1,232,536, U.S. Pat. No. 4,691,770, this tool being used to isolate wellhead equipment from pressure in the casing or tubing, depending on which it is set into; McLeod, a Wellhead Isolation Tool, U.S. Pat. No. 4,991,650, this tool being used to isolate wellhead equipment from pressure in the casing or tubing, depending on which it is set into; Bullen, a Well Tree Saver, Canadian Patent No. 1,094,945, this tool being used to isolate the wellhead array from pressure in the tubing; Cummins (Assigned to Halliburton Co.) a Wellhead Isolation Tool and Method of Use Thereof, U.S. Pat. No. 3,830,304, this tool being used to isolate the wellhead array from pressure in the tubing. Oliver (Assigned to Halliburton Co.) Wellhead Isolation Tool, U.S. Pat. No. 4,111,261, showing a tool much like the Cummins Patent but including a nipple system for the mandrel; Sutherland-Wenger, a Wellhead Isolation Tool Nipple, Canadian Pat. No. 1,272,684. This shows a nipple on a mandrel which is moved into the wellhead by a concentric telescoping cylinder; Dallas et al, A Wellhead Isolation Tool and Method of Using Same, Canadian Patent No. 1,267,078, U.S. Pat. No. 4,867,243 which shows a removable cylinder moving a mandrel into the wellhead. There are many other tools operating on the same principle; to insert a mandrel with a sealing nipple on the lower end through the wellhead and into the tubing or casing below the wellhead, thus isolating the wellhead from the pressure and fluid being pumped into the tubing or casing.

The isolation tools in general use have the following drawbacks.

1. During the insertion of the mandrel into the wellhead with the isolation tools proposed by McLeod, Bullen, Dallas et al and others, the wellhead valves are open and if there were to be damage to the mandrel or a leak to occur in the mandrel packing of the isolation tool, there is the great possibility of the well blowing out with the attendant danger to personnel and environment.

Thus for example, referring to FIG. 2 of Canadian patent no. 1,267,078 of Dallas et al, when the mandrel 24 is inserted into the wellhead, the valves 11A and 11B will be open. If there is a leak in the mandrel packing (see FIG. 2*b*, element 22), well fluids could pass between the mandrel and the wellhead fittings, between the mandrel and the flange 20 and into the environment thus potentially causing an uncontrollable blowout.

2. The isolation tools described by McLeod (U.S. Pat. No. 4,991,650), Sutherland-Wenger and others, use a combination pressure chamber and hydraulic cylinder to protect the mandrel or confine any leaks through mandrel packing. (Those of Cummins and Oliver protect only a portion of the mandrel during operation.) This does confine any possible blowout, but due to the construction of the pressure chamber and hydraulic cylinder, the isolation tool assembly is very high and the attachment to the well servicing equipment is far above the ground.

For example, referring to FIGS. 2A, 2B and 3 of Oliver, U.S. Pat. No. 4,111,261, the lower extension 162 of a mandrel 38 is integral with the piston 180 and contained within a cylinder 36. An upper mandrel extension 164 which is connected to the upper end of the lower extension 162 of the mandrel extends upward through the cylinder 36 and terminates is a valve 210 through which high pressure fluids may be added to the well during servicing of the well. The resultant high structure remains on the well during the servicing.

The height of the structure leads to high bending and twisting loads on the wellhead when acidizing and fracturing services are being performed. This can lead to damage to the wellhead and problems with removal of the isolation tool.

It is desirable to have an isolation tool configuration which will protect the mandrel when it is being inserted in the wellhead, protect the personnel and environment from the dangers of a blowout if there is a catastrophic leak in the mandrel packing and also have the protective container and the insertion mechanism removable from the wellhead once the mandrel has been installed in order to have in place a low profile isolation tool.

The invention in one aspect may be viewed as an insertion apparatus for protecting and inserting a mandrel through the low pressure wellhead and associated equipment. The insertion apparatus attaches to the wellhead in a pressure sealing way and remains in place while the mandrel is being inserted through the wellhead and sealing in the tubing with one of the many available sealing nipples. The mandrel is locked in place and then the insertion apparatus is taken off.

The well servicing equipment is then attached and the servicing done. After the servicing, the insertion apparatus is sealed to the wellhead and the mandrel extracted. The wellhead valves are closed and the insertion apparatus removed.

In one aspect the invention comprises an improvement to a wellhead isolation tool having a mandrel and a packing which are protected and pressure sealed from the surroundings during insertion of the mandrel in the wellhead by the insertion system of the wellhead isolation tool.

In a second aspect the invention comprises an improvement to a wellhead isolation tool having a mandrel and a packing and the insertion and pressure sealing portion of the isolation tool being removable from the wellhead after insertion of the mandrel by the isolation tool.

More specifically there is provided a wellhead isolation tool for attachment to a wellhead, the wellhead including tubing, the wellhead isolation tool comprising:

a pressure tight cylindrical unit having a cylindrical bore;

a rod forcibly reciprocatable within the cylindrical bore of the unit, the rod having a lower end and a latch attached to the lower end of the rod;

a mandrel attachable onto and detachable from the latch, the mandrel having a sealing nipple;

an isolation valve attachable to the cylindrical unit;

means for attaching the wellhead isolation tool to the wellhead;

the cylindrical unit, the isolation valve, and the attaching means defining a sealed bore for the mandrel and rod to move within;

and the mandrel being movable from a first position out of the wellhead to a second position with the sealing nipple sealed against the tubing.

The mandrel is preferably locked within the wellhead, using a locking spool separate from the attaching means and from the isolation valve. Valves are preferably also provided to equalize pressure across the sealing nipple while the mandrel is lowered into the wellhead.

In another aspect of the invention there is provided a method of isolating a wellhead from high pressures, the wellhead having a wellhead valve which is initially closed and the wellhead having well tubing, the method comprising:

inserting a mandrel into a sealed wellhead isolation tool, the mandrel having a sealing nipple on its lower end, the wellhead isolation tool having a cylindrical sealed hydraulic means for receiving and reciprocatably moving the mandrel, an isolation valve attached to the cylindrical sealed hydraulic means and means for attachment of the wellhead isolation tool to the wellhead;

attaching the wellhead isolation tool to the wellhead;

opening the wellhead valve;

inserting the mandrel into the wellhead with the sealing nipple sealed against the tubing;

closing the isolation valve; and removing the cylindrical sealed hydraulic means from the isolation valve.

BRIEF DESCRIPTION OF THE DRAWINGS

There will now be described a preferred embodiment of the invention, with reference to the drawings, by way of illustration, in which like numerals denote like elements and in which.

DETAILED DESCRIPTION OF PREFERRED EMBODIMENTS

Figure 1:
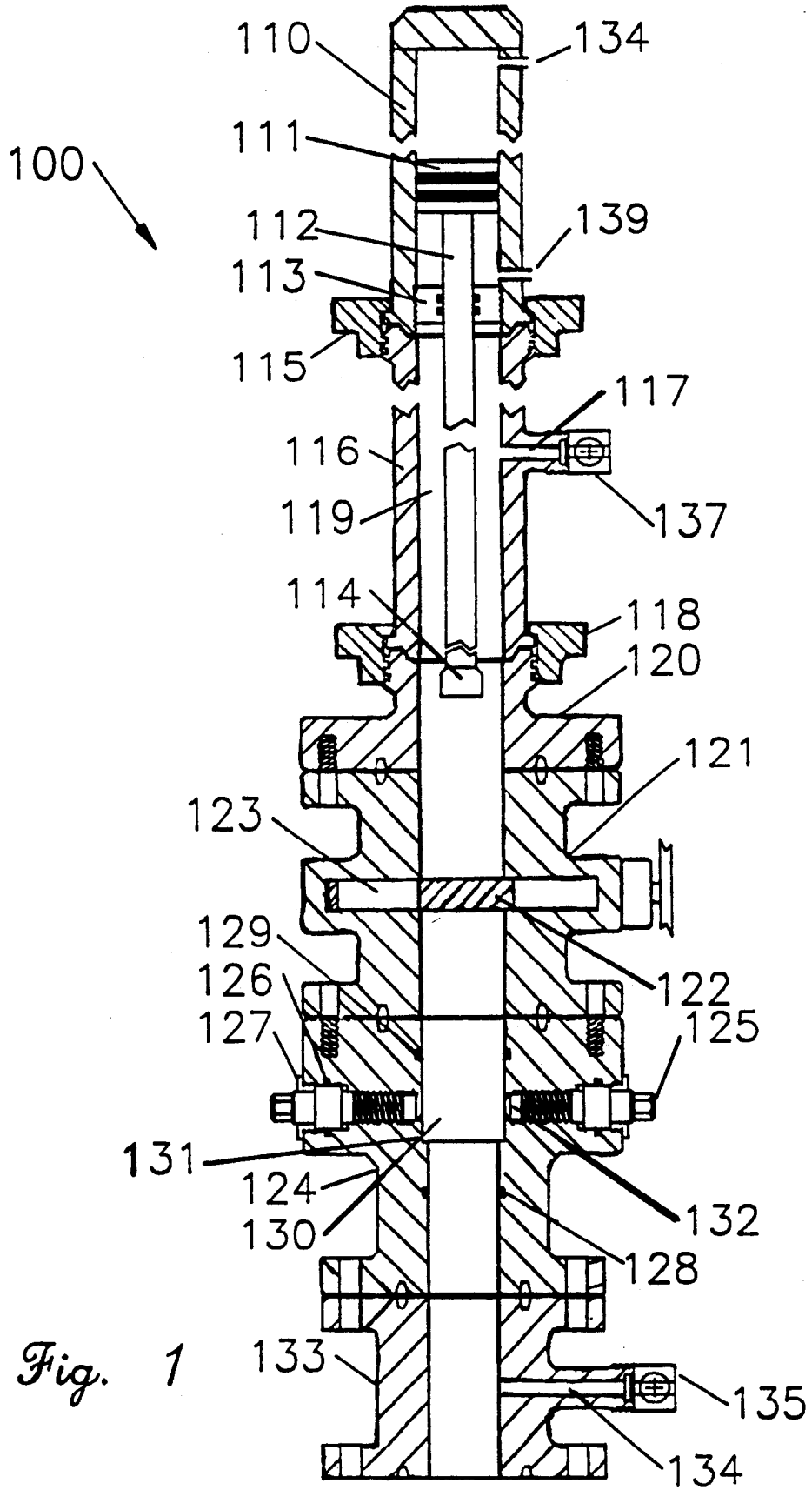
FIG. 1 shows an apparatus according to the invention in side view cross section.

Referring to FIG. 1, the wellhead isolation tool shown generally at 100 is made up of a hydraulic cylinder 110 having an upper fluid port 134 and lower fluid port 139 for receiving hydraulic fluid into the bore of the cylinder 110. A piston 111 is moveable in the hydraulic cylinder and is connected to a rod 112. The rod 112 extends through a packing 113 and terminates at its lower end in a mandrel latch sub connection 114. The hydraulic cylinder is attached by an upper sealing union 115 to a cylindrical pressure casing 116. The cylindrical pressure casing and the rod 112 define an annular space 119. Port 117 is provided in the casing 116 and includes a bleed valve 137 and lower sealing union 118. The hydraulic cylinder 110 and pressure casing 116 together make up a sealed or pressure tight unit having a cylindrical bore. A pump or pumps (not shown) may be used to forcibly reciprocate the piston and therefore the rod in the cylinder.

The lower sealing union connects the pressure casing to a changeover flange 120. The changeover flange is attached to the upper end of an isolation valve 121 which has a gate 122 and a port in the gate 123. The isolation valve is shown with the port in the closed position. The isolation valve is attached at its lower end to a mandrel locking spool 124 which has one or more threaded locking screws 125 fitted around the spool in a circumferential pattern, each locking screw having a point 132. The screw is shaped to fit in a locking groove 205 in the mandrel (see FIG. 2*a*). The locking spool includes a pressure seal 126 and a retaining gland nut 127, which is threaded into the locking spool and may therefore be turned with the result that the point of the screw can enter into inner bore 130 of the locking spool. The locking spool is for locking the mandrel within the wellhead with the nipple 209 (described below) of the mandrel in sealing relationship with the tubing 305 of the well (see discussion in relation to FIG. 3). The inner bore of the locking spool has pressure seals 128 and 129 and a shoulder 131.

The locking spool is attached at its lower end to a tee 133 which has outlet 134 and tee valve 135. The components are all constructed to be capable of retaining the well servicing pressure.

Figure 2A:
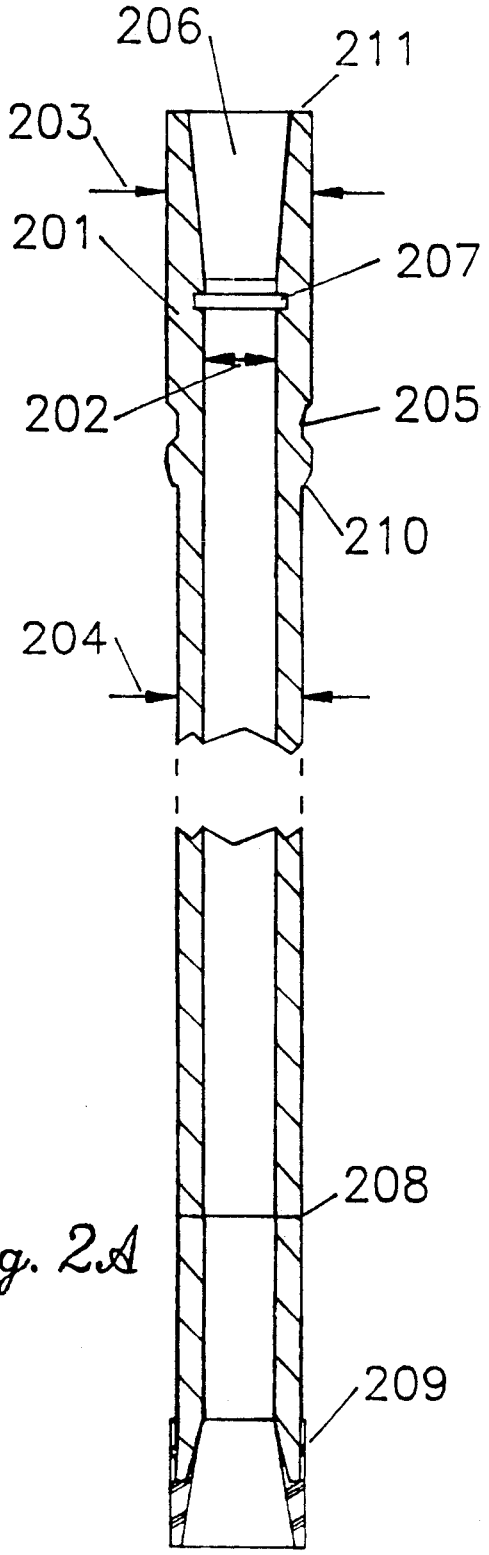
FIG. 2*a* shows a mandrel and nipple in side view cross section.

Referring to FIG. 2*a*, there is shown a mandrel 201 with an inner diameter 202, a conical passage 206 at an upper end of the mandrel leading into the bore of the mandrel. The mandrel has an upper section with an outside diameter 203 and a lower section with an outside diameter 204. An external locking groove 205 is provided at an upper part of the mandrel in the upper section and an internal latching groove 207 is also provided in the upper section. A shoulder 210 is formed between the upper and lower sections of the mandrel. The mandrel is also provided with a lower connection 208. The top shoulder of the mandrel is shown at 211. Shown at 209 is a sealing nipple which could be one of the several on the market, for instance, McLeod, U.S. Pat. No. 4,601,494.

Figure 2B:
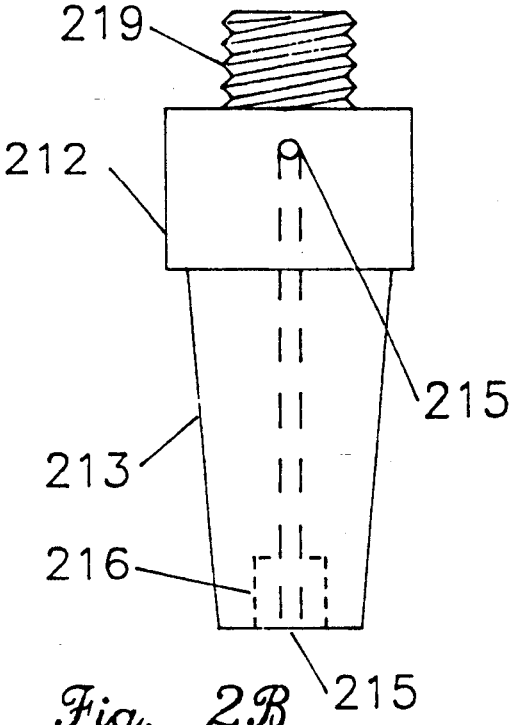
FIG. 2*b* shows a mandrel latch sub.

Referring to FIG. 2*b*, there is shown a mandrel latch sub 212 with a conical body portion 213 to fit the conical passage 206 in the mandrel, internal thread 216 for attaching to one of the latches described below, external thread 219 for connection to rod 112 and fluid pressure passage 215.

Figure 2C:
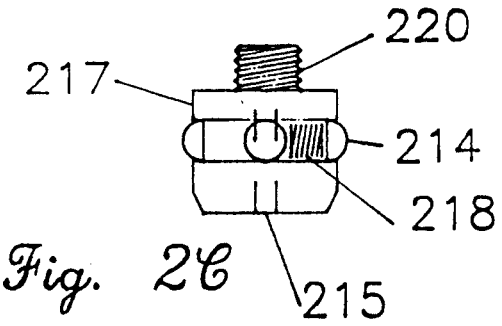
FIG. 2*c* shows a mandrel insertion latch.

Referring to FIG. 2*c*, there is shown an insertion latch 217 with the captive detent balls 214 secured in recesses circumferentially disposed around the latch. Secured within the recesses are ball spring loads 218. An attachment thread 220 is provided for mounting the assembly to the mandrel latch sub internal thread. A fluid pressure passage 215 is provided centrally through the latch 217 that interconnects with the latch sub passage.

Figure 2D:
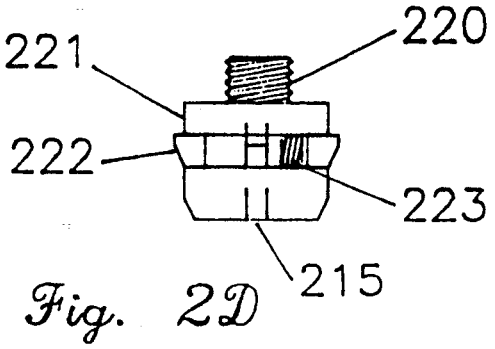
FIG. 2*d* shows a mandrel extraction latch.

Referring to FIG. 2*d* there is shown an extraction latch 221 with captive dogs 222 secured in recesses circumferentially disposed about the latch. The recesses include dog springs 223. An attachment thread 220 is provided for mounting the assembly to the mandrel latch sub internal thread. A fluid pressure passage 215 is centrally disposed within the latch 221.

Figure 3:
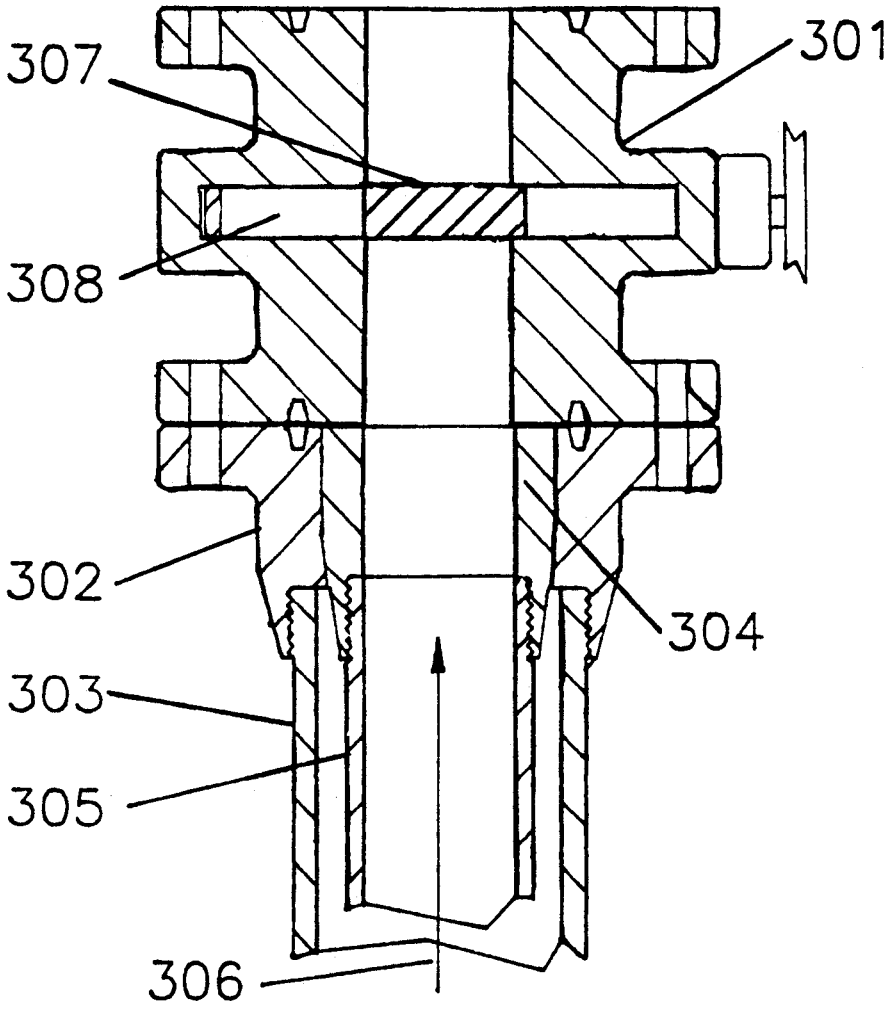
FIG. 3 shows a simplified wellhead in cross section.

Referring to FIG. 3, there is shown a simplified wellhead consisting of a wellhead valve 301 with a gate 307 and a port in the gate 308 shown in the closed position, a casing head 302 attached to casing 303, and a tubing hanger 304 from which hangs tubing 305. Well pressure is noted by the upward pointing arrow 306. The present invention has been described with the mandrel sealing against tubing in a well, but it will be appreciated by a person skilled in the art that the mandrel could seal against casing, and the term tubing as used in the claims should be taken to refer to casing.

Figure 4:
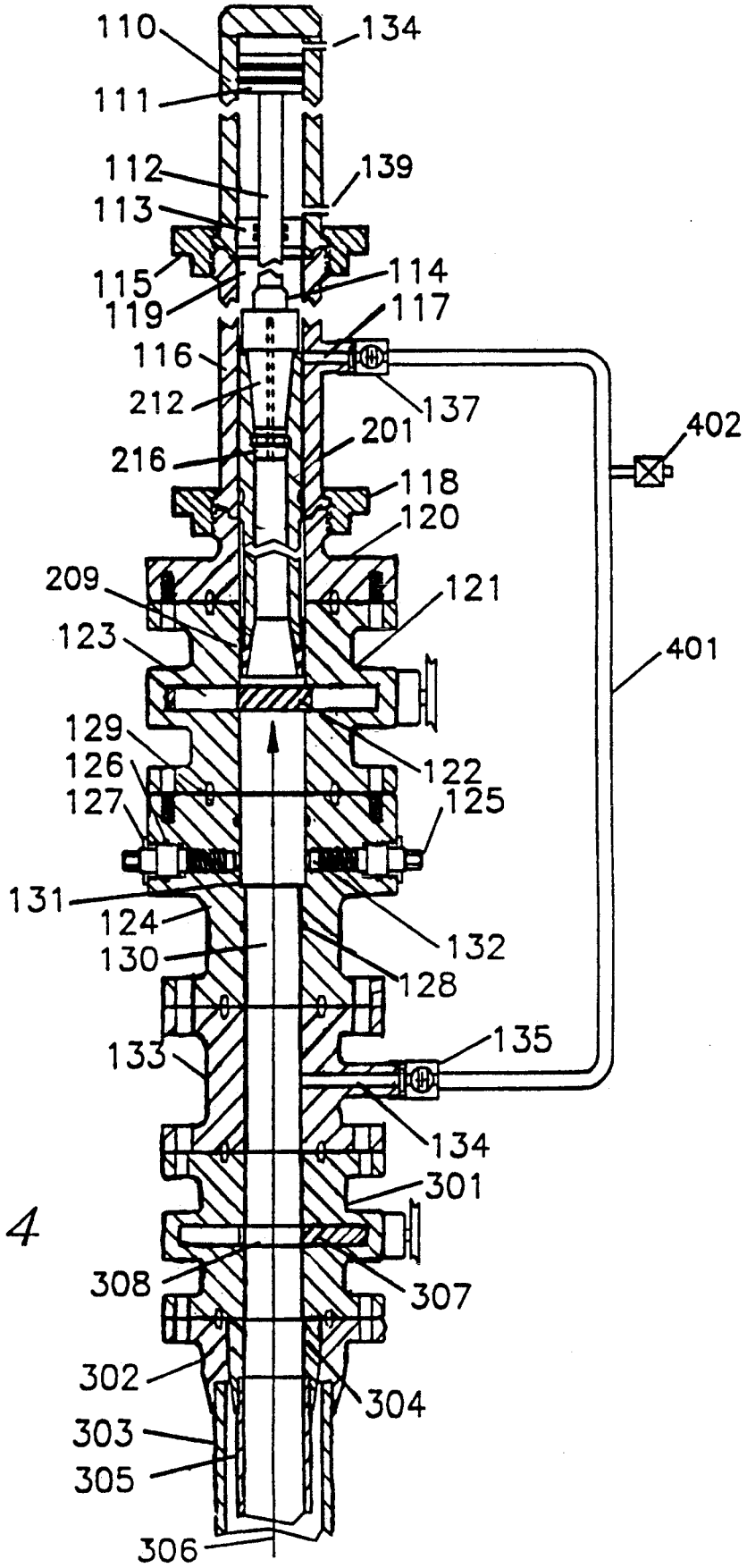
FIG. 4 shows the apparatus from FIG. 1 mounted on the wellhead from FIG. 3 and showing the position of the items from FIG. 2.

Referring to FIG. 4, there is shown the isolation tool from FIG. 1 attached to the wellhead of FIG. 3. In the embodiment shown, the tee 133 is used as means to attach the wellhead isolation tool to the wellhead, the top of which in the embodiment shown is represented by the valve 301. Other flanges or spools might in appropriate circumstances be used as the connection to the wellhead. For example, the locking spool might attach directly to the wellhead. Also, the locking elements 125 might be formed with the isolation valve. The mandrel from FIG. 2*a*, mandrel latch sub from FIG. 2*b* and insertion latch from FIG. 2*c* are assembled and attached to the mandrel latch connection in the isolation tool. The bleed valve 137 in the pressure casing is in the closed position. The tee valve 135 is in the closed position. Equalizing line 401 with the bleed valve 402 is connected between the two valves. The wellhead valve gate is in the open position, allowing well pressure noted by the arrow 306 up to the closed gate of the isolation valve.

Figure 5:
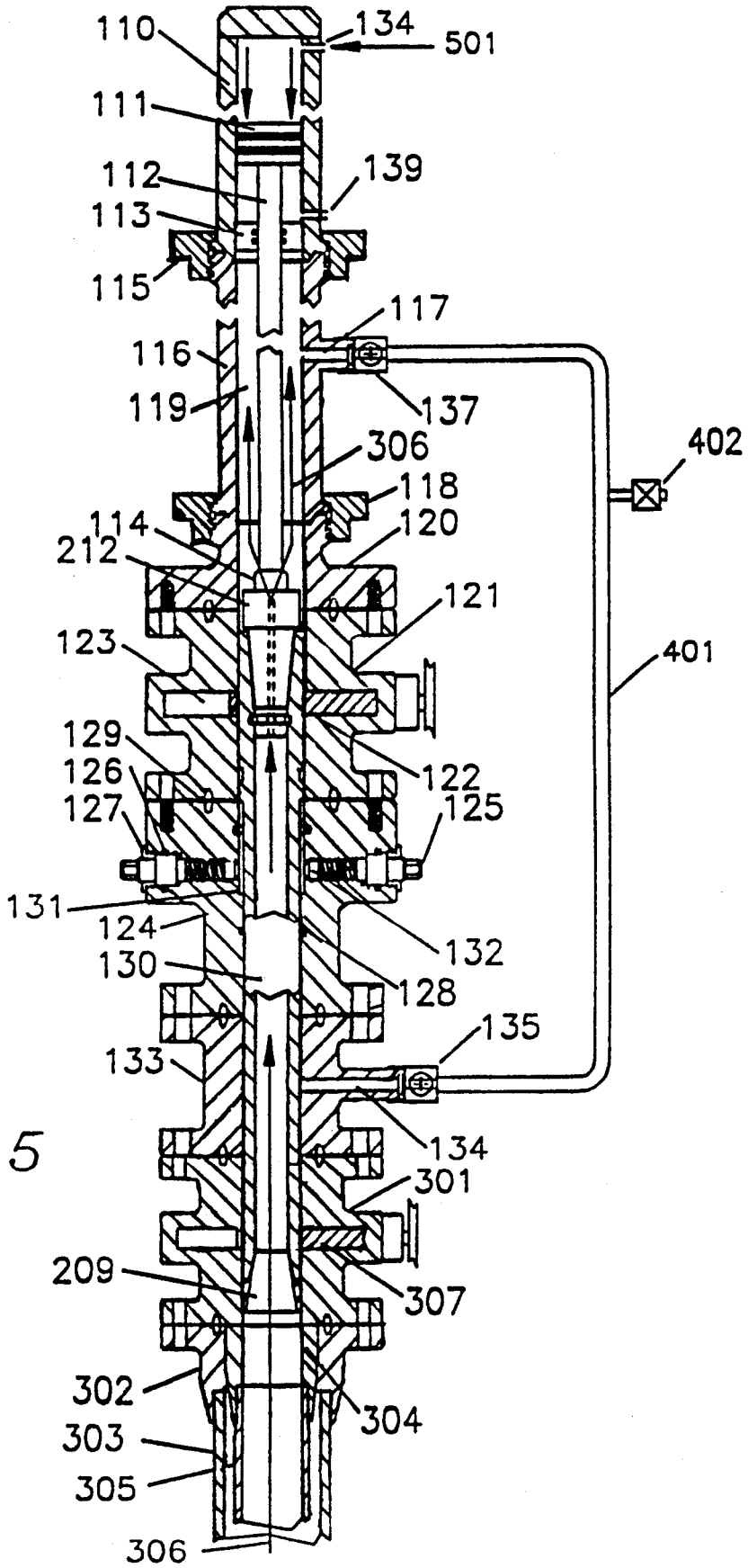
FIG. 5 shows the apparatus from FIG. 4 with the mandrel in an intermediate position in the wellhead.

Referring to FIG. 5, the isolation tool valve gate is in the open position and the mandrel and nipple attached to the rod by the mandrel latch sub and insertion latch are shown after being moved into position in the isolation valve and the locking spool bore by the action on the piston of hydraulic fluid 501 pumped into the port 134. Well pressure noted by arrows is confined in the pressure casing.

Figure 6:
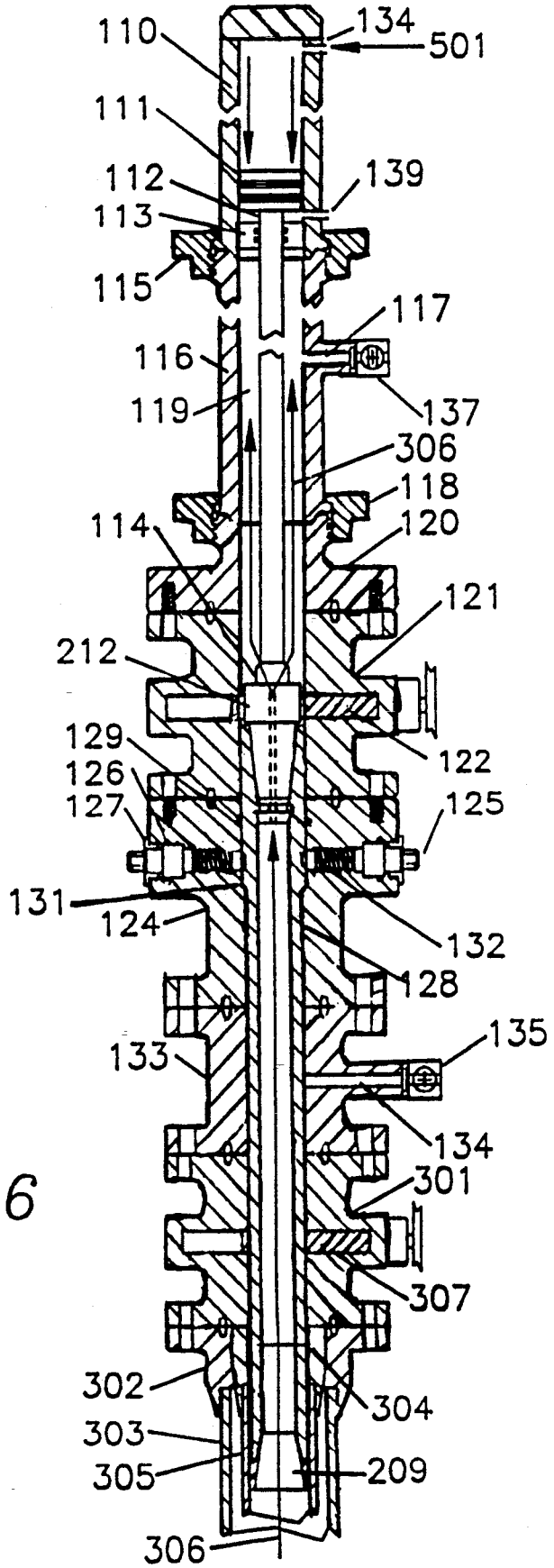
FIG. 6 shows the apparatus from FIG. 5 with the mandrel locked in place in the wellhead.

Referring to FIG. 6, the mandrel has been moved into place in the locking spool 124, the shoulder 210 of the mandrel meeting the shoulder 131 of the locking spool and the locking screw(s) 125 have been turned in to engage their points 132 in the mandrel external locking groove 205. The seals 128 and 129 in the locking spool seal on the upper outside diameter 203 and lower outside diameter 204 of the mandrel and will isolate pressure from the isolation valve side from migrating into the wellhead. The seal in the tubing by the sealing nipple isolates pressure from the tubing from migrating into the wellhead. The wellhead is thus protected from any servicing pressures and fluids. The pressure casing bleed valve is closed after the mandrel has been locked in place, the equalizing line is bled of pressure and taken off and the tee valve is open and will show if there is leakage from any of the sealing areas.

Figure 7:
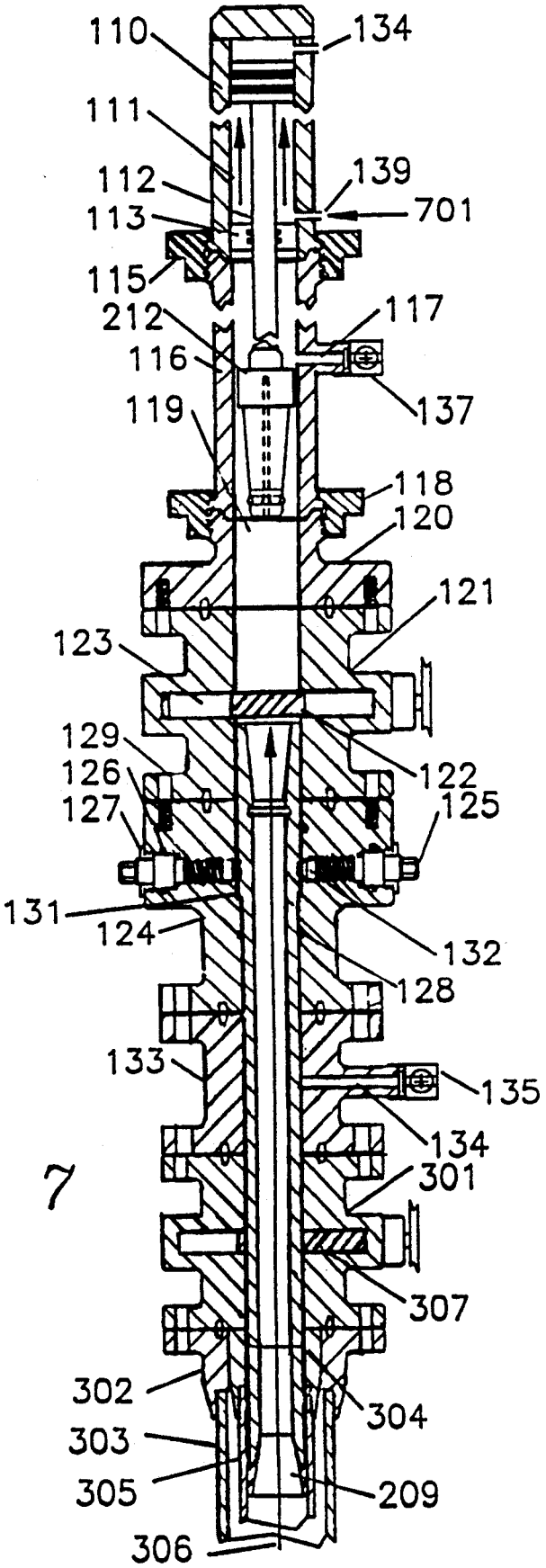
FIG. 7 shows the apparatus from FIG. 6 with the mandrel insertion latch withdrawn from the mandrel and the isolation valve closed.

Referring to FIG. 7, hydraulic fluid 701 has been pumped in port 139, the piston has moved upwards in the cylinder and the mandrel latch sub and insertion latch has detached from the mandrel and moved out of the isolation valve. The isolation valve gate is in the closed position. Fluid or gas pressure in the pressure casing is bled off through the open bleed valve.

Figure 8:
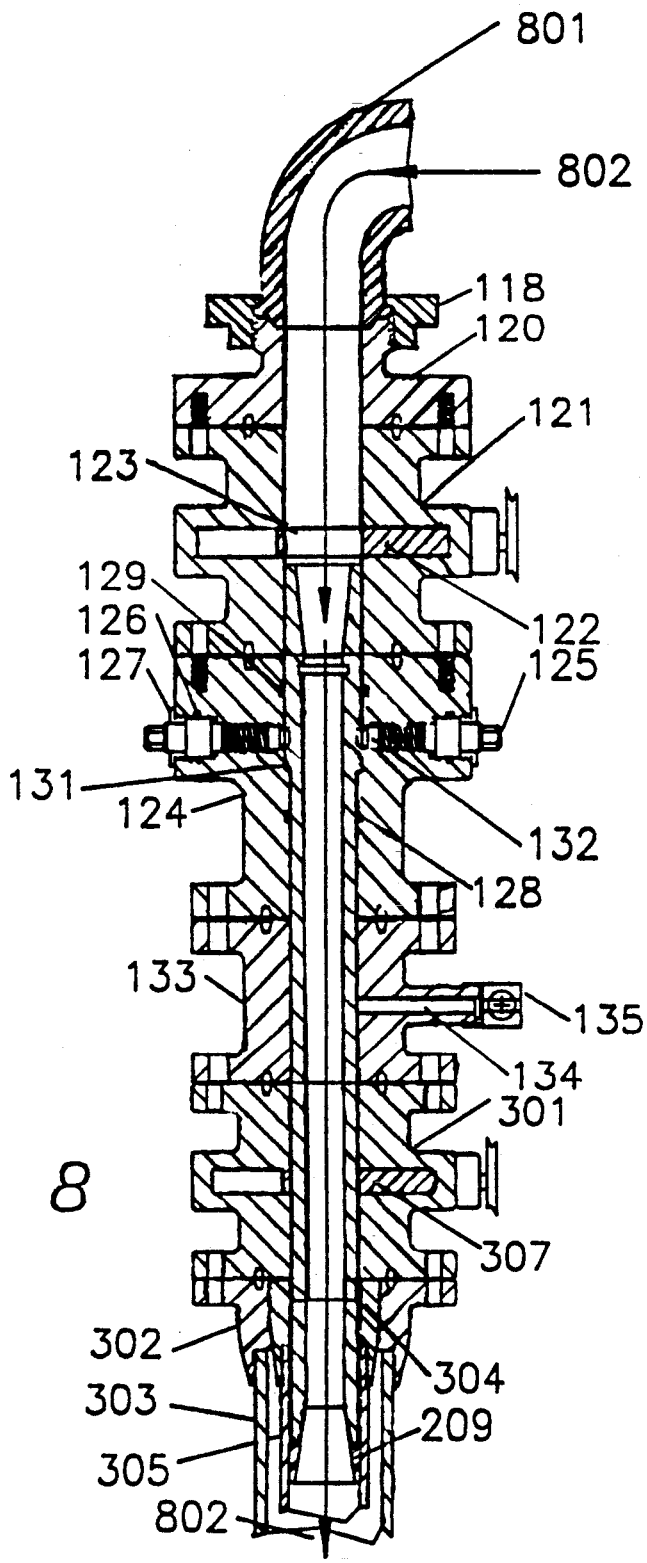
FIG. 8 shows the apparatus from FIG. 7 with the hydraulic cylinder and pressure casing taken off and fluids being pumped down the well and the wellhead isolated from these fluids and pressures.

Referring to FIG. 8, the assembly of the hydraulic cylinder, mandrel latch sub and insertion latch and the pressure casing have been taken off and the servicing piping 801 has been attached with the lower sealing union. The isolation valve shown in the open position now controls the well and the fluids and pressure being pumped shown as 802 will go through the mandrel which is sealed in the locking spool and the tubing and will not migrate into the wellhead fittings.

The operation of the tool will now be described. Referring to FIG. 4, the mandrel from FIG. 2*a*, mandrel latch sub from FIG. 2*b* and insertion latch from FIG. 2*c* are assembled and attached to the mandrel latch connection 114 in the isolation tool from FIG. 1. The bleed valve 137 in the pressure casing is in the closed position. The tee valve 135 is in the closed position. The isolation tool has been attached to the wellhead of FIG. 3 in the usual way. Equalizing line 401 is connected between the bleed valve and the T valve. The wellhead valve gate 307 is opened allowing well pressure noted by the arrow 306 up to the closed gate 122 of the isolation valve 121. The tool is now ready to insert the mandrel into the wellhead.

Referring to FIG. 5, the isolation valve gate 122 is opened. The bleed valve 137 and the T valve 135 connected by the equalizing line 401 are opened. Hydraulic fluid 501 is pumped into the port 134. The amount of this fluid is measured so that the position of the piston and thus the rest of the assembly on the rod will be known. The piston 111 and rod 112 with the mandrel attached by the mandrel latch sub 212 and insertion latch are moved through the isolation valve and the locking spool bore by the action on the piston of the hydraulic fluid. Well pressure noted by arrows 306 has travelled through the fluid pressure passage 215 in the mandrel latch sub and is confined in the pressure casing and the equalizing line. The purpose of the equalizing line is to allow the nipple 209 to enter and seat in the tubing 305 without any pressure differential which could cause the sealing elastomer on the nipple to be deformed and not seal properly. In some cases, when the wellhead isolation tool is attached to the wellhead, the isolation valve may already be in the open position and may therefore not need opening.

Referring to FIG. 6, the mandrel has been moved into place in the locking spool 124, the shoulder 210 of the mandrel meeting the shoulder 131 of the locking spool. A rise in the hydraulic fluid pressure being pumped in will confirm this abutment. The locking screw(s) 125 are turned in to engage their points 132 in the mandrel external locking groove 205. Their abutment in this groove will also confirm that the mandrel is in place. The seals 128 and 129 in the locking spool seal on the upper outside diameter 203 and lower outside diameter 204 of the mandrel and will isolate pressure from the isolation valve side from migrating into the wellhead. The seal in the tubing by the sealing nipple isolates pressure from the tubing from migrating into the wellhead. The wellhead is thus protected from any servicing pressures and fluids. The pressure casing bleed valve is closed after the mandrel has been locked in place, the equalizing line is bled of pressure and taken off and the tee valve is open and will show if there is leakage from any of the sealing areas. This is left open during servicing.

Referring to FIG. 7, the movement of the mandrel latch sub out of the latching spool is shown. Hydraulic fluid 701 is pumped into port 139, the piston moves upwards in the cylinder and the mandrel latch sub and insertion latch detaches from the mandrel due to the action of the spring loaded balls 214. It is possible that the pressure from the well will assist or even cause the moving of the piston and rod, in which case, port 134 of the hydraulic cylinder will be used to control the movement in a throttling way. The isolation valve gate will be closed when the mandrel latch sub is moved above the gate. Fluid or gas pressure in the pressure casing will be bled off through the open bleed valve. The hydraulic cylinder and pressure casing is now under no pressure and may be removed from the rest of the assembly.

Referring to FIG. 8, the assembly of the hydraulic cylinder, mandrel latch sub and insertion latch and the pressure casing are taken off at the lower sealing union 118, and the servicing piping 801 is attached. The isolation valve shown in the open position now controls the well and the fluids and pressure being pumped shown as 802 will go through the mandrel which is sealed in the locking spool and the tubing and will not migrate into the wellhead fittings.

Extraction of the mandrel from the well is carried out as a reverse of this procedure as follows. The isolation valve gate is closed, and the servicing piping 801 removed. The extraction latch 221 is attached to the mandrel latch sub. The hydraulic cylinder and pressure casing are installed on the isolation valve. The equalizing line 401 is attached to the bleed valve and the tee valve. The isolation valve is opened. The bleed valve 137 is opened. Hydraulic fluid is pumped into the port 134 and the extraction latch moved into the internal latch groove in the mandrel. When the mandrel latch sub is latched in the mandrel, the locking screws are released and the mandrel withdrawn into the bore of the pressure casing by the hydraulic cylinder. The wellhead valve is then closed. The pressure from the isolation tool is bled off at the equalizing line bleed valve 402 and the isolation tool may be taken off the wellhead in the usual way.

Due to the area on the top of the mandrel being larger than the area of the nipple and mandrel at the bottom, there may be occasions in which no lock downs are needed for the mandrel. However, there are many occasions when it is required to flow the well back through the mandrel and this would cause an unrestrained mandrel to move. It would also be impossible to install in a zero pressure well. Thus it is believed to be desirable to include the locking means. Other methods of locking the mandrel may be used other than as shown.

The overall unit could be built more compact by for example as noted above combining the locking spool and the tee. This, however, is not preferred, since replacement of the tee due to wear would require replacement of the locking system as well. Also, the locking system may also be made part of the isolation valve. However, the isolation valve is an off-the-shelf component and to add the locking system to it would require it to be custom made. Also, the isolation valve is subject to washing out from the abrasive fluids passing through it and requires replacing more frequently than the locking spool. Therefore it is preferred that the isolation valve and locking spool be separate components. The locking system itself could omit the screws and use for example two split collars that mate with the locking groove in the mandrel.

The equalizing line and valves may or may not be required depending on well pressures. It is believed to be best to use it all the time to relieve small pressure differentials.

While simple preferred latches have been shown, other latching techniques may be used, for example, overshoot or force latch.

To accommodate different lengths of mandrels, different lengths of pressure casing and cylinder may be used, or a longer pressure casing and cylinder may be used with different lengths of mandrels.

ALTERNATIVE EMBODIMENTS

A person skilled in the art could make immaterial modifications to the invention described and claimed in this patent without departing from the essence of the invention.

I claim:

1. A wellhead isolation tool for attachment to an oil and gas wellhead, the wellhead including tubing, the wellhead isolation tool comprising:

a pressure tight cylindrical unit having a cylindrical bore and a lower flange;

a rod forcibly reciprocatable entirely within the cylindrical bore of the unit, the rod having a lower end and a latch attached to the lower end of the rod;

a mandrel attachable onto and detachable from the latch, the mandrel having a sealing nipple;

an isolation valve attached and sealed to the lower flange of the cylindrical unit;

means for attaching the wellhead isolation tool to the wellhead;

the cylindrical unit and the isolation valve defining a sealed bore for the mandrel and rod to be sealed entirely within;

and the mandrel being movable from a first position out of the wellhead and entirely sealed within the sealed bore to a second position with the sealing nipple sealed against the tubing.

2. The wellhead isolation tool of claim 1 further including means forming part of the wellhead isolation tool below the isolation valve for retaining the mandrel in the wellhead below the isolation valve with the isolation valve closed.

3. The wellhead isolation tool of claim 2 in which the locking means is a locking spool separate from the attaching means and from the isolation valve.

4. The wellhead isolation tool of claim 3 in which the attaching means includes a first valve.

5. The wellhead isolation tool of claim 4 in which the cylindrical unit includes a second valve connected by a line to the first valve.

6. The wellhead isolation tool of claim 2 in which the cylindrical unit comprises a cylinder and a pressure casing, the cylinder having fist and second ports for receiving hydraulic fluid.

7. A method of isolating an oil and gas wellhead from high pressure, the wellhead having a wellhead valve which is initially closed and the wellhead having well tubing, the method comprising the steps of:

providing a rod and mandrel latched to the rod, the rod and mandrel being entirely sealable within a sealed wellhead isolation tool, the mandrel having a sealing nipple on its lower end, the wellhead isolation tool having a cylindrical sealed hydraulic means for receiving and reciprocatably moving the mandrel, an isolation valve attached tot he cylindrical sealed hydraulic means and means for attachment of the wellhead isolation tool to the wellhead;

attaching the wellhead isolation tool to the wellhead with the mandrel and rod entirely sealed within the isolation tool above the wellhead;

opening the wellhead valve;

inserting the mandrel into the wellhead with the sealing nipple sealed against the tubing;

unlatching the rod from the mandrel and removing the rod from the wellhead;

closing the isolation valve; and removing the cylindrical sealed hydraulic means from the isolation valve.

8. The method of claim 7 in which the cylindrical unit includes a cylinder, a piston within the cylinder, a rod attached to the piston, a latch on the rod, pressure casing attached to the cylinder and a mandrel latched to the rod, and inserting the mandrel into the wellhead comprises: lowering the mandrel into the wellhead; locking the mandrel into the wellhead; and removing the rod from the mandrel.

9. The method of claim 7 in which the isolation valve is initially closed and further including opening the isolation valve after attaching the wellhead isolation tool to the wellhead.

10. The method of claim 7 further including equalizing pressure above and below the nipple after opening the wellhead valve.

* * * * *